US009504112B1

(12) United States Patent
Cho et al.

(10) Patent No.: US 9,504,112 B1
(45) Date of Patent: Nov. 22, 2016

(54) ADAPTIVE LIGHTING DRIVER

(71) Applicants: Nam Chin Cho, Peachtree City, GA (US); Vaske Mikani, Senoia, GA (US)

(72) Inventors: Nam Chin Cho, Peachtree City, GA (US); Vaske Mikani, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/794,573

(22) Filed: Jul. 8, 2015

(51) Int. Cl.
*H05B 37/02* (2006.01)
*H05B 33/08* (2006.01)

(52) U.S. Cl.
CPC ..... *H05B 33/0845* (2013.01); *H05B 33/0809* (2013.01); *H05B 37/0209* (2013.01)

(58) Field of Classification Search
CPC ..... H05B 33/0845; H05B 33/0809; H05B 37/0209
USPC ..... 315/200 R, 307, 224, 291
See application file for complete search history.

(56) References Cited

U.S. PATENT DOCUMENTS 8,610,365 B2 * 12/2013 King ..... H05B 33/0815 315/246
2010/0164406 A1 * 7/2010 Kost ..... H05B 33/0815 315/307
2011/0309759 A1 * 12/2011 Shteynberg ..... H05B 33/0815 315/201
2013/0069561 A1 * 3/2013 Melanson ..... H05B 33/0815 315/297

OTHER PUBLICATIONS

Office Action mailed Feb. 9, 2016 for U.S. Appl. No. 14/794,579.
LEDs Magazine; Improve phase-cut dimming performance in LED luminaires; Dec. 2013.

* cited by examiner

*Primary Examiner* — Daniel D Chang
(74) *Attorney, Agent, or Firm* — King & Spalding LLP

(57) ABSTRACT

A method of adapting output power of a driver to conduction duration of a phase-cut dimmer includes determining a first conduction duration of an electrical signal generated by a phase-cut dimmer. The first conduction duration corresponds to a dimmest setting of the phase-cut dimmer. The method further includes storing a first value corresponding to the first conduction duration and determining a second conduction duration of the electrical signal. The second conduction duration corresponds to a brightest setting of the phase-cut dimmer. The method also includes storing a second value corresponding to the second conduction duration and generating intermediate values that are between the first value and the second value. The method further includes adjusting an output power of a driver based on a conduction duration of the electrical signal, the first value, the second value, and the intermediate values.

20 Claims, 6 Drawing Sheets

ADAPTIVE LIGHTING DRIVER

TECHNICAL FIELD

The present disclosure relates generally to lighting solutions, and more particularly to adjusting a dim curve of a driver.

BACKGROUND

A driver (e.g., an LED driver) is often used to provide power to the light sources of a lighting device. In some applications, a dimmer may be used to control the power that is provided by the driver to a light source to control the intensity of light emitted by a light source. For example, a phase-cut dimmer may be used to control the dim level of light emitted by a light source (e.g., LEDs). However, because of variations in operating ranges of phase-cut dimmers, the range of intensity levels of light emitted by a light source may be different from one dimmer to another.

To illustrate, phase-cut dimmers perform dimming operations by passing a portion of the power from a power source to a light source or to a driver that is attached to a light source depending on a dim level setting. In general, phase-cut dimmers conduct a portion of each half cycle of the power signal (e.g., mains power signal) based on the dim level setting. To illustrate, a phase-cut dimmer may pass a small percentage of the power (e.g., mains power) when the dimmer is set to a dimmest setting (e.g., slider of the dimmer is at lowest level) and may pass a relatively large percentage of the power from the power source when the dimmer is set to a brightest setting (e.g., slider is at highest level). The dim level of light from a light source that is controlled by a dimmer corresponds to the conduction duration of the electrical signal that is passed to a driver or to the light source.

The conduction duration of an electrical signal provided by a dimmer is associated with maximum and minimum firing angles of the dimmer. Because the firing angles of phase-cut dimmers vary significantly from one manufacturer to another, lighting systems that are otherwise similar may behave differently based on the maximum and minimum conduction durations of the dimmers that are used with the systems. If a driver is configured to provide a lowest and highest output power to a light source based on minimum and maximum conduction durations of an electrical signal from a particular dimmer, the driver may not provide the same lowest and highest output power when coupled to a different phase-cut dimmer.

Thus, a solution that allows the driver to learn the maximum and minimum dimming capability of a dimmer that is attached to the driver is desirable.

SUMMARY

The present disclosure relates generally to lighting solutions. In an example embodiment, a method of adapting output power of a driver to an operating range of a phase-cut dimmer includes determining a first conduction duration of an electrical signal generated by a phase-cut dimmer. The first conduction duration corresponds to a dimmest setting of the phase-cut dimmer. The method further includes storing a first value corresponding to the first conduction duration and determining a second conduction duration of the electrical signal, where the second conduction duration corresponds to a brightest setting of the phase-cut dimmer. The method also includes storing a second value corresponding to the second conduction duration and generating intermediate values that are between the first value and the second value. The method further includes adjusting an output power of a driver based on a conduction duration of the electrical signal, the first value, the second value, and the intermediate values, wherein changing a dim level setting of the phase-cut dimmer changes the conduction duration of the electrical signal.

In another example embodiment, a lighting system includes a phase-cut dimmer, a light source, and an adaptive driver coupled to the phase cut dimmer and to the light source. The adaptive driver includes a conduction duration detector to determine a conduction duration of the electrical signal, where changing a dim level setting of the dimmer changes the conduction duration of the electrical signal. The adaptive driver further includes a memory device to store values corresponding to the conduction duration of the electrical signal. The values include a first value, a second value, and intermediate values that are between the first value and the second value. the first value corresponds to a minimum conduction duration of the electrical signal determined by the conduction duration detector. The second value corresponds to a maximum conduction duration of the electrical signal determined by the conduction duration detector. The intermediate values correspond to intermediate conduction durations of the electrical signal. The adaptive driver also includes power processor to provide power to the light source based on the first value, the second value, and the intermediate values.

In another example embodiment, a lighting fixture includes a light emitting diode (LED) driver and an adaptive driver coupled to the light source. The adaptive driver includes a conduction duration detector to determine a conduction duration of the electrical signal based on the rectified electrical signal, where changing a dim level setting of the dimmer changes the conduction duration of the electrical signal. The adaptive driver further includes a memory device to store values corresponding to the conduction duration of the electrical signal. The values include a first value, a second value, and intermediate values that are between the first value and the second value. The first value corresponds to a minimum conduction duration of the electrical signal determined by the conduction duration detector. The second value corresponds to a maximum conduction duration of the electrical signal determined by the conduction duration detector. The intermediate values correspond to intermediate conduction durations of the electrical signal. The adaptive driver also includes a power processor to provide power to the light source based on the first value, the second value, and the intermediate values.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1A:
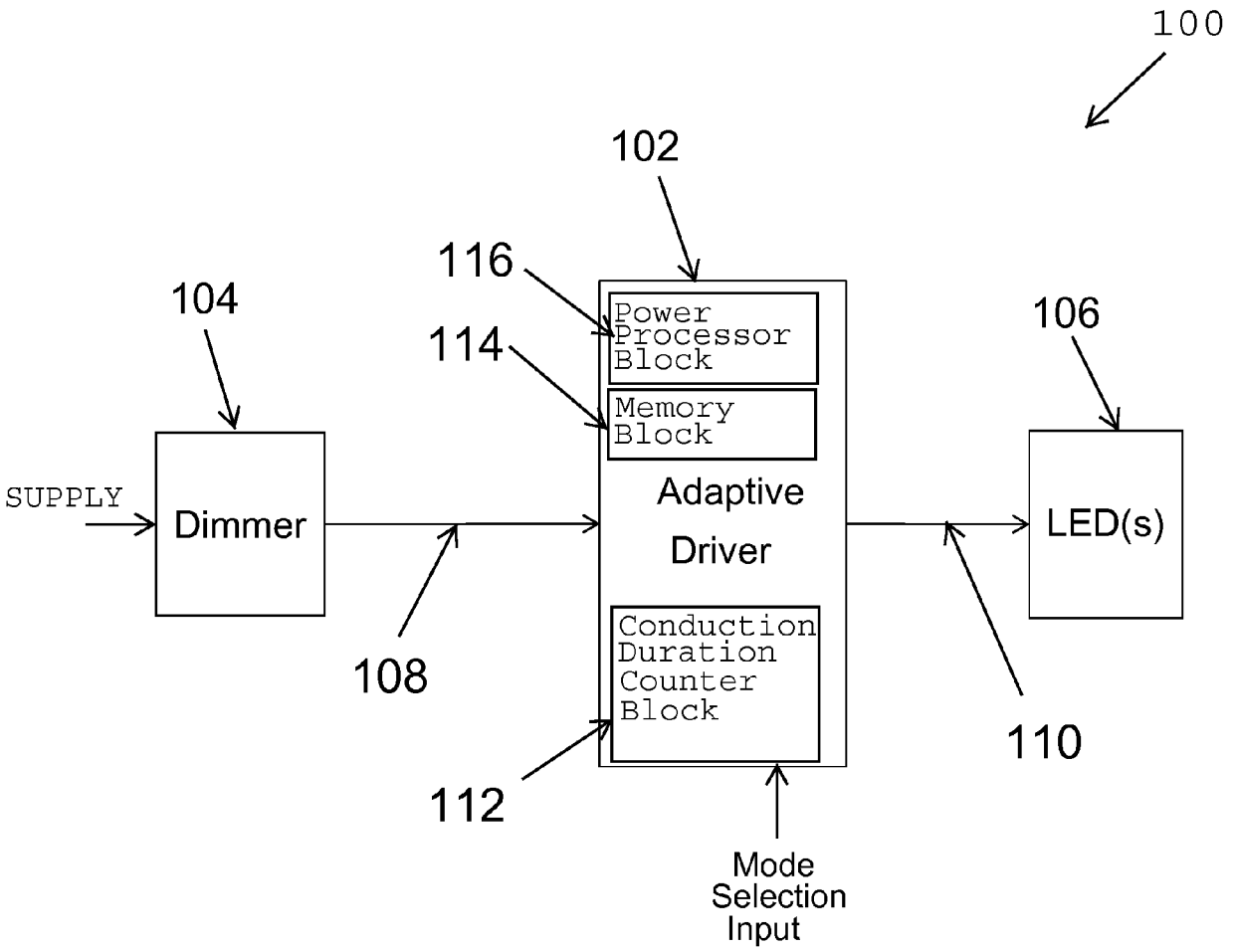
FIG. 1A illustrates a lighting system including an adaptive driver that adapts to a dimmer according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular embodiments are described. FIG. 1A illustrates a lighting system 100 including an adaptive driver 102 that adapts to a dimmer 104 according to an example embodiment. As illustrated in FIG. 1A, the lighting system 100 includes the adaptive driver 102, the dimmer 104, and one or more light emitting diodes (LEDs) 106. In some example embodiments, the one or more LEDs 106 may be one or more discrete LEDs, one or more organic light-emitting diodes (OLEDs), an LED chip on board that includes one or more discrete LEDs, an array of discrete LEDs, or light source(s) other than LEDs.

In some example embodiments, the dimmer 104 is a phase-cut (triac) dimmer that generates an output electrical signal on a connection 108 by limiting the power that is transferred from a power source (SUPPLY) (e.g., mains power source) to the adaptive driver 102. In some example embodiments, the power source (SUPPLY) may be a 120-volt, 60-Hertz power source. Alternatively, the power source (SUPPLY) may be 210-volt, 50-Hertz or another power source.

In general, the conduction duration of the electrical signal generated by the dimmer 104 corresponds to the dim level setting. For example, the electrical signal generated by the dimmer 104 may have a maximum conduction duration shown in FIG. 1B when the dimmer 104 is set to a brightest setting. Similarly, the electrical signal may have the minimum conduction duration shown in FIG. 1C when the dimmer 104 is set to a dimmest setting. The electrical signal has intermediate conduction durations that are between the maximum and minimum conduction durations for dim level settings that are between the brightest and dimmest settings.

In some example embodiments, conduction durations may be expressed in terms of time units or degrees. To illustrate, for a 60-Hz power source, a maximum conduction duration must be less than approximately 8.3 milliseconds (ms) or 180 degrees. For example, the maximum conduction duration may be approximately 6.9 ms or 150 degrees, and a minimum conduction duration may be approximately 1.4 ms or 30 degrees. For a 50-Hz power source, a maximum duration must be less than 10 milliseconds (ms) or 180 degrees. For example, for a 50-Hz power source, the maximum conduction duration may be approximately 8.3 ms or 150 degrees, and a minimum conduction duration may be approximately 1.7 ms or 30 degrees.

In some example embodiments, the dimmer 104 may have a slider for adjusting the dim level setting. Alternatively, the dim level setting may be controlled by other means known to those of ordinary skill in the art.

In some example embodiments, the adaptive driver 102 may receive the electrical signal provided by the dimmer 104 via the connection 108 and provide power to the LEDs 106 via a connection 110. For example, the connection 108 and the connection 110 may each be one or more electrical wires. The power provided to the LEDs 106 by the adaptive driver 102 is in proportion to the conduction duration of the electrical signal provided by the dimmer 104. Because the conduction duration of the electrical signal provided by the dimmer 104 is related to the dim level setting, changing the dim level setting of the dimmer 104 may thus change the power provided by the adaptive driver 102 to the LEDs 106.

In some example embodiments, the adaptive driver 102 may include a conduction duration counter block 112, a memory block 114, and a power processor block 116. To illustrate, the conduction duration counter block 112 may determine the conduction duration of the electrical signal provided by the dimmer 104 on the connection 108. The power processor block 116 may provide power to the LEDs 106 based on the conduction duration determined by the conduction duration counter block 112. For example, the memory block 114 may contain values (e.g., power generation parameter values such as pulse width, duty cycle, etc.) corresponding to and/or associated with different conduction durations, and the power processor block 116 may use the conduction duration determined by the conduction duration counter block 112 and a corresponding value stored in the memory block 114 to provide to the LEDs 106 an amount of power that corresponds to the conduction duration determined by the conduction duration counter block 112.

In some example embodiments, the values stored in the memory block 114 may have been generated by the conduction duration counter block 112. To illustrate, the conduction duration counter block 112 may determine (e.g., measure) the minimum and maximum conduction durations of the electrical signal that is provided by the dimmer 104 on the connection 108 and store a first value and a second value that respectively correspond to the minimum and maximum conduction durations in the memory block 114. For example, the conduction duration counter block 112 may determine the maximum conduction duration shown in FIG. 1B and the minimum conduction duration shown in FIG. 1C, where the electrical signal generated by the dimmer 104 on the connection 108 has the maximum duration when the dimmer 104 is set/adjusted to the brightest level and has the minimum conduction duration when the dimmer 104 is set/adjusted to the dimmest setting. In general, the minimum and maximum conduction durations of the electrical signal provided by the dimmer 104 on the connection 108 correspond respectively to dimmest and brightest settings of the dimmer 104.

Based on the first and second values that correspond to the minimum and maximum conduction durations, the conduction duration counter block 112 may determine (e.g., calculate) intermediate values that correspond to intermediate conduction values that are between the minimum and maximum conduction durations. The conduction duration counter block 112 may store the intermediate values in the memory block 114, for example, in association with corresponding intermediate conduction durations that are between the minimum and maximum conduction durations. For example, the conduction duration counter block 112 may determine (e.g., calculate) the intermediate values that correspond to intermediate conduction durations based on a desired dim curve (e.g., square law curve, S curve, linear curve, etc.), and the minimum and maximum conduction durations. In some example embodiments, the conduction duration counter block 112 may determine (e.g., calculate) intermediate conduction durations that are between the minimum and maximum conduction.

In some example embodiments, the conduction duration counter block 112 may determine the minimum and maximum conduction durations and store the corresponding values as well as the intermediate values in the memory block 114 during a training mode operation of the adaptive driver 102. To illustrate, in some example embodiments, Mode Selection Input or other means may be used to select a training mode operation of the adaptive driver 102. For example, using the Mode Selection Input (e.g., a switch, a keyboard input, etc.), a user may select a training mode during which the adaptive driver 102 stores values, corresponding to conduction durations and generated as described above, in the memory block 114.

In some example embodiments, after the memory block 114 is updated with values corresponding to the minimum, maximum, and intermediate conduction durations, a user may select a normal operation mode using the Mode Selection Input during which the user uses the dimmer 104 to control the brightness level of the light emitted by the LEDs 106 based on the values stored in the memory block 114.

After values corresponding to the minimum, maximum, and intermediate conduction durations are stored in the memory block 114, the power processor block 116 may provide power to the LEDs 106 based on the stored values and the conduction duration of the electrical signal provided by the dimmer 104 on the connection 108, where the conduction duration of the electrical signal corresponds to the dim level setting of the dimmer 104.

Figure 1B:
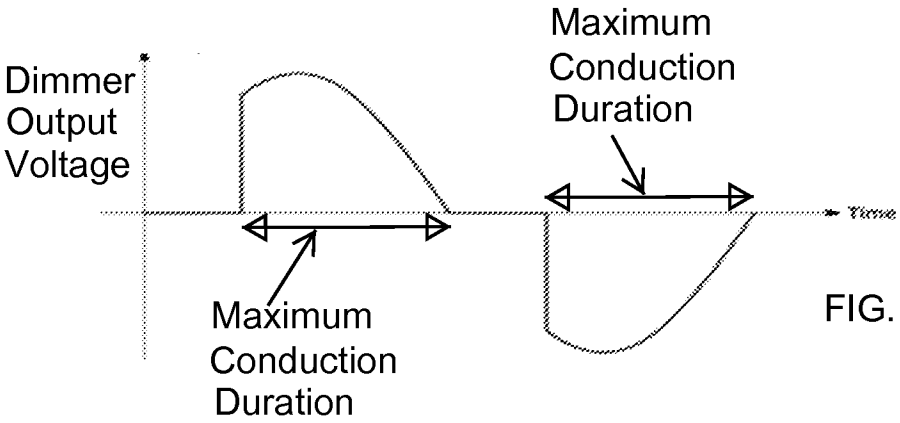
FIGS. 1B and 1C illustrate waveform conduction durations of an output electrical signal of the dimmer of FIG. 1A corresponding to brightest and dimmest settings of the dimmer according to an example embodiment.
Figure 1C:
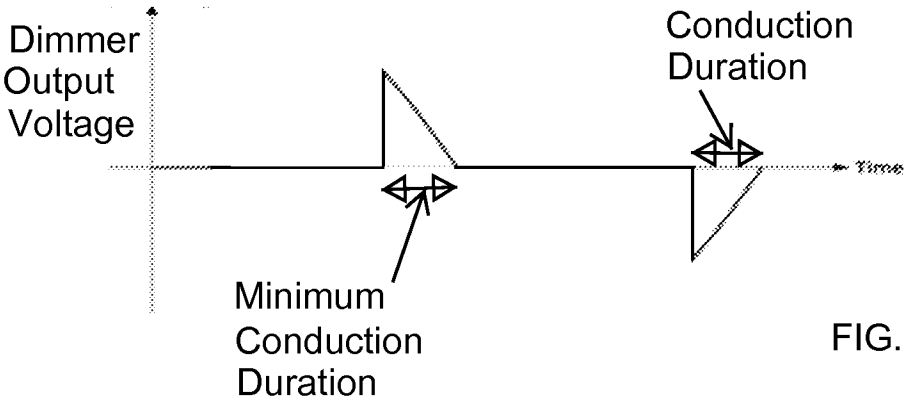

For example, when the electrical signal on the connection 108 has the maximum conduction duration shown in FIG. 1B (corresponding to a brightest setting of the dimmer 104), the power processor block 116 may provide an amount of power to the LEDs 106 such that the light emitted by the LEDs 106 has a full brightness level. When the electrical signal provided by the dimmer 104 has the minimum conduction duration shown in FIG. 1C (corresponding to the dimmest setting of the dimmer 104), the adaptive driver 102 may provide another amount of power to the LEDs 106 such that the light emitted by the LEDs 106 has a minimum brightness level (e.g., 1 percent of full brightness). When the electrical signal provided by the dimmer 104 has a conduction duration that is between the minimum and maximum conduction durations, the adaptive driver 102 may provide an amount of power to the LEDs 106 that results in the light emitted by the LEDs 106 having a brightness level that is between the minimum and the full brightness levels.

In some example embodiments, prior to the conduction duration counter block 112 storing values corresponding to the conduction durations as described above in the memory block 114, the memory block 114 may contain default values or values that correspond to the conduction durations of another dimmer. However, because the stored values may not proportionally correspond to the actual minimum and maximum conduction durations of the electrical signal provided by the dimmer 104, the brightness level of the light emitted by the LEDs 106 may not proportionally correspond to the dim level setting of the dimmer 104. For example, the stored values that result in maximum and/or minimum power being provided by the adaptive driver 102 to the LEDs 106 may not correspond to the actual minimum and maximum conduction durations of the electrical signal provided by the dimmer 104. In turn, the brightness level of the light emitted by the LEDs 106 may not proportionally correspond to the dim level setting of the dimmer 104. For example, the mismatch between the stored values the actual conduction durations may result in dead-travel and/or sag. Thus, determining and storing values that correspond to the conduction durations of the electrical signal provided by the dimmer 104 may eliminate or reduce undesirable behavior of the system, such as dead-travel and sag.

In some example embodiments, the adaptive driver 102 and the LEDs 106 may be included in a light fixture. Alternatively, the system 100 may be a light fixture. In some alternative embodiments, the adaptive driver 102 may determine the minimum and maximum conduction durations of the electrical signal generated by the dimmer 104 and store corresponding values in the memory block 114 during normal mode operations instead of during a training mode. For example, in some embodiments, the training mode may be omitted.

Figure 2A:
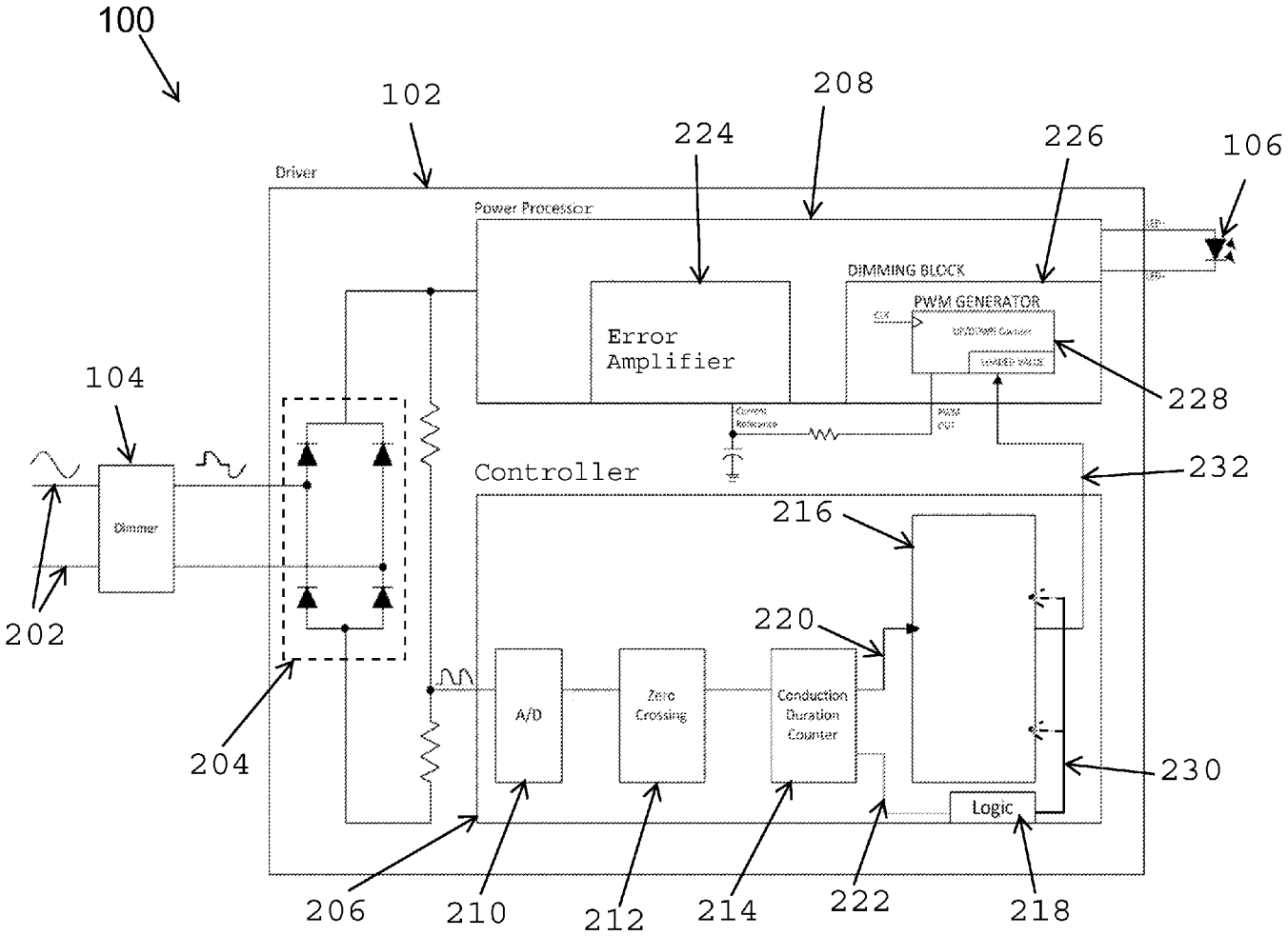
FIGS. 2A and 2B illustrate details of the system of FIG. 1A according to an example embodiment.
Figure 2B:
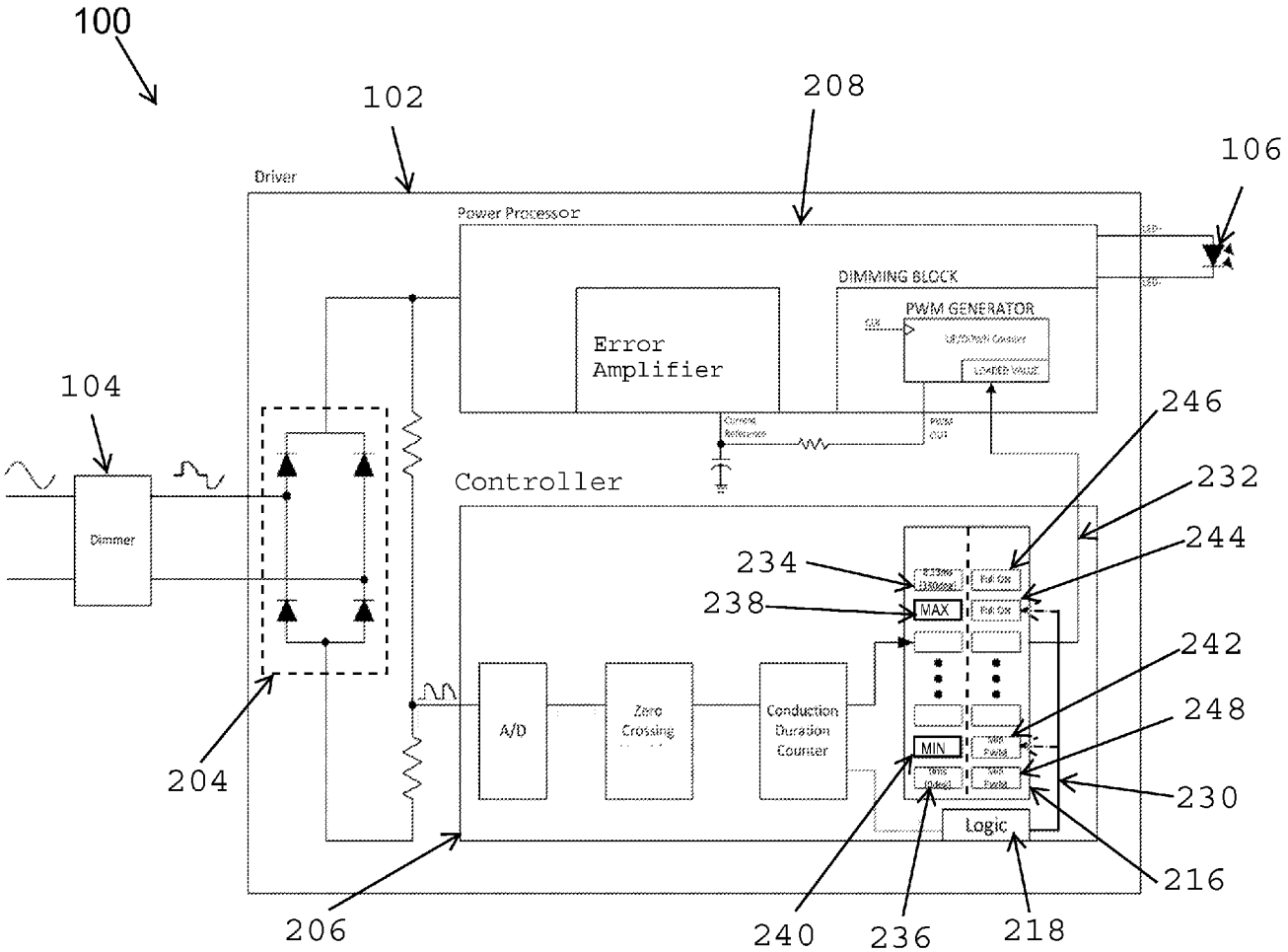

FIGS. 2A and 2B illustrate details of the lighting system 100 of FIG. 1A according to an example embodiment. Referring to FIGS. 2A and 2B, the system 100 includes the adaptive driver 102, the dimmer 104, and the LEDs 106. Power from a power source (e.g., the power source (SUPPLY) shown in FIG. 1A) may be provided to the dimmer 104 via connections 202. The dimmer 104 (e.g., a triac dimmer) provides the electrical signal to the adaptive driver 102 by limiting the amount of power that is transferred to the adaptive driver 102 from the power source based on the dim level setting.

In some example embodiments, the adaptive driver 102 includes a rectifier 204, a controller 206, and a power processor 208. The rectifier 204 may receive and rectify the electrical signal provided by the dimmer 104. Although a particular rectifier is shown in FIGS. 2A and 2B, in alternative embodiments, a different rectifier may be used to rectify the electrical signal. As shown in FIGS. 2A and 2B, the rectified signal is provided to the Controller 206. For example, the controller 206 may include an analog-to-digital converter (A/D) 210, a zero crossing block 212, a conduction duration counter 214, a memory device 216, and a logic block 218. In some example embodiments, one or more of the zero crossing block 212, the conduction duration counter 214, and the logic block 218 may be implemented in hardware, software, or a combination thereof.

The A/D converter 206 may convert the rectified analog electrical signal into a digital electrical signal and provide the digital electrical signal to the zero crossing block 212. The zero crossing block 212 may determine zero crossings of the electrical signal provided by dimmer 104 based on the digital electrical signal and generate an output signal that indicates zero crossings. The signal generated by the zero crossing block 212 is provided to the conduction duration counter 214. The conduction duration counter 214 may determine the conduction duration of the electrical signal generated by dimmer 104 based on the output of the zero crossing block 212.

During normal operations, where a user uses the dimmer 104 to change the intensity level of light emitted by the LEDs 106, the output of the conduction duration counter 214 is used to read/output values from the memory device 216 that correspond to the conduction durations of the electrical signal generated by the dimmer 104. The values read/output from the memory device 216 are provided to the power processor 208 via a connection 232 (e.g., one or more electrical wires) and are used by the power processor 208 in generating the power that is provided to the LEDs 106. For example, the values stored in the memory device 216 may be pulse-width-modulation values (e.g., duty cycle values, pulse-width, etc.) that are used to control the amount of power generated by the power processor 208 and provided to the LEDs 106. When the dim level setting of the dimmer 104 changes, resulting in a different conduction duration, a value corresponding to the changed conduction duration may be read from the memory device 216, resulting in a different amount of power being provided to the LEDs 106 by the power processor 208.

In some example embodiments, the power processor 208 may include an error amplifier 224 and a dimming block 226 that includes a pulse-width-modulation (PWM) generator 228. For example, the PWM generator 228 may receive a value (e.g., a pulse-width value) stored in the memory device 216, and the dimming block 226 in conjunction with the error amplifier 224 may operate to control the amount of power provided to the LEDs 106.

In some example embodiments, the values stored in the memory device 216 may be default values or values that correspond to conduction durations of a different dimmer. For example, the dimmer 104 may be a replacement dimmer. In such cases, the conduction duration counter 214 may determine the minimum and maximum conduction durations of the electrical signal provided to the adaptive driver 102 by the dimmer 104, and the logic block 218 may use the output of the conduction duration counter 214 to store values (e.g., duty cycle values, pulse-width values, etc.) corresponding to the minimum and maximum conduction durations in the memory device 216.

For example, during a training mode of the system 100, a user may adjust the dim level setting of the dimmer 104 to the dimmest setting followed by the brightest setting to allow the adaptive driver 102 to determine the minimum and maximum conduction durations of the electrical signal generated by the dimmer 104. Alternatively, a user may adjust the dim level setting of the dimmer 104 to the brightest setting followed by the dimmest setting. As described above, the dimmest setting and the brightest setting correspond to the minimum and maximum conduction durations of the electrical signal generated by the dimmer 104 based on the dim level setting of the dimmer 104.

During the training mode, the logic block 218 may use the output of the conduction duration counter 214 to store in the memory device 216 a first value that corresponds to the minimum conduction duration of the electrical signal generated by the dimmer 104 and to store a second value that corresponds to the maximum conduction duration of the electrical signal generated by the dimmer 104. For example, the first value may correspond to an amount of power that results in a dimmest intensity level (e.g., 1% of full intensity level) of the light emitted by the LEDs 106. Similarly, the second value may correspond to an amount of power that results in a brightest intensity level (e.g., 1 full intensity level) of the light emitted by the LEDs 106. The logic block 218 may provide the first and second values to the memory device 218 via a connection 230, which may include one or more electrical wires.

In some example embodiments, the logic block 218 may also generate (e.g., calculate) intermediate values that are between the first and second values based on a desired dimming curve (e.g., square law curve, S curve, linear, etc.) and store the intermediate values in the memory device 216, for example, in association with corresponding intermediate conduction durations that are between the minimum and maximum conduction durations.

During a normal operation mode, when dim level setting of the dimmer 104 is adjusted to the dimmest setting, the first value stored in the memory device 216 may be used to generate an amount of power by the power processor 208 that results in a dimmest intensity level (e.g., 1% of full intensity level) of the light emitted by the LEDs 106. Similarly, when dim level setting of the dimmer 104 is adjusted to the brightest setting, the second value stored in the memory device 216 may be used to generate an amount of power by the power processor 208 that results in a brightest intensity level (e.g., full intensity level) of the light emitted by the LEDs 106.

When dim level setting of the dimmer 104 is adjusted to a setting that is between the dimmest setting and the brightest setting, the power processor 208 may use a corresponding intermediate value stored in the memory device 216 to provide an amount of power to the LEDs 106 that results in an intensity level of the light that is between the dimmest intensity level and the brightest intensity level. Thus, by determining the actual minimum and maximum conduction durations of the electrical signal generated by the dimmer 104 and provided to the adaptive driver 102, and storing values that proportionally correspond to the minimum, maximum, and intermediate conduction durations, unwanted system behavior, such as dead-travel and sag, may be eliminated or reduced.

In some example embodiments, the rectifier 204, the A/D 210, the zero crossing block 212, the conduction duration counter 214 and the logic block 218 may be included in the conduction duration counter block 112 of FIG. 1A. One or more of these blocks may be implemented in hardware, software, or a combination thereof. In some example embodiments, the memory block 114 of FIG. 1A may include the memory device 216, which, for example, may be an SRAM or other memory device as can be understood by those of ordinary skill in the art. In some example embodiments, the power processor block 116 of FIG. 1A may include the power processor 208.

In some example embodiments, the memory device 216 may be used to store values (e.g., PWM values), as described above, in association with conduction duration values. For example, a first column of the memory device 216 may include memory locations that store minimum, maximum and intermediate conduction duration values, and a second column of the memory device 216 may include memory locations that store power generation parameter values, such as PWM values, that are generated by the logic block 218 and stored in association with the conduction duration values. Alternatively, the first column may represent addresses corresponding to minimum, maximum and intermediate conduction durations, and the second column may include memory locations containing values generated by the logic block 218 and stored in association with the conduction durations as described above.

To illustrate, a memory location or address 238 may correspond a maximum conduction duration, and the memory location 244, which is associated with the memory location or address 238, may contain a power generation parameter value (e.g., pulse width value, duty cycle value, etc.) that corresponds to a full intensity level of the light emitted by the LEDs 106. A memory location or address 240 may correspond to a minimum conduction duration, and the memory location 242, which is associated with the memory location or address 240, may contain a power generation parameter value that corresponds to a lowest intensity level (e.g., 1% of full intensity level) of the light emitted by the LEDs 106. Memory locations or addresses in the first column of the memory device 216 that are between the locations or addresses 238 and 240 may correspond to intermediate conduction durations. Intermediate power generation parameter values that correspond to intermediate conduction durations may be stored between the memory locations 244 and 242 in association with intermediate conduction durations.

Further, in some example embodiments, the memory location or address 234 and the memory location 246 may be associated with full intensity level of the light emitted by the LEDs 106. For example, the memory location or address 234 and the memory location 246 may correspond to a 180-degree conduction duration. Similarly, the memory location or address 236 and the memory location 248 may be associated a 0-degree conduction duration and lowest intensity level of the light emitted by the LEDs 106.

In some example embodiments, the controller 206 may be a microcontroller. In general, one or more of the components of the system 100 may be implemented using hardware (e.g., microcontroller, an FPGA, ASIC, etc.), software, or a combination thereof.

Figure 3:
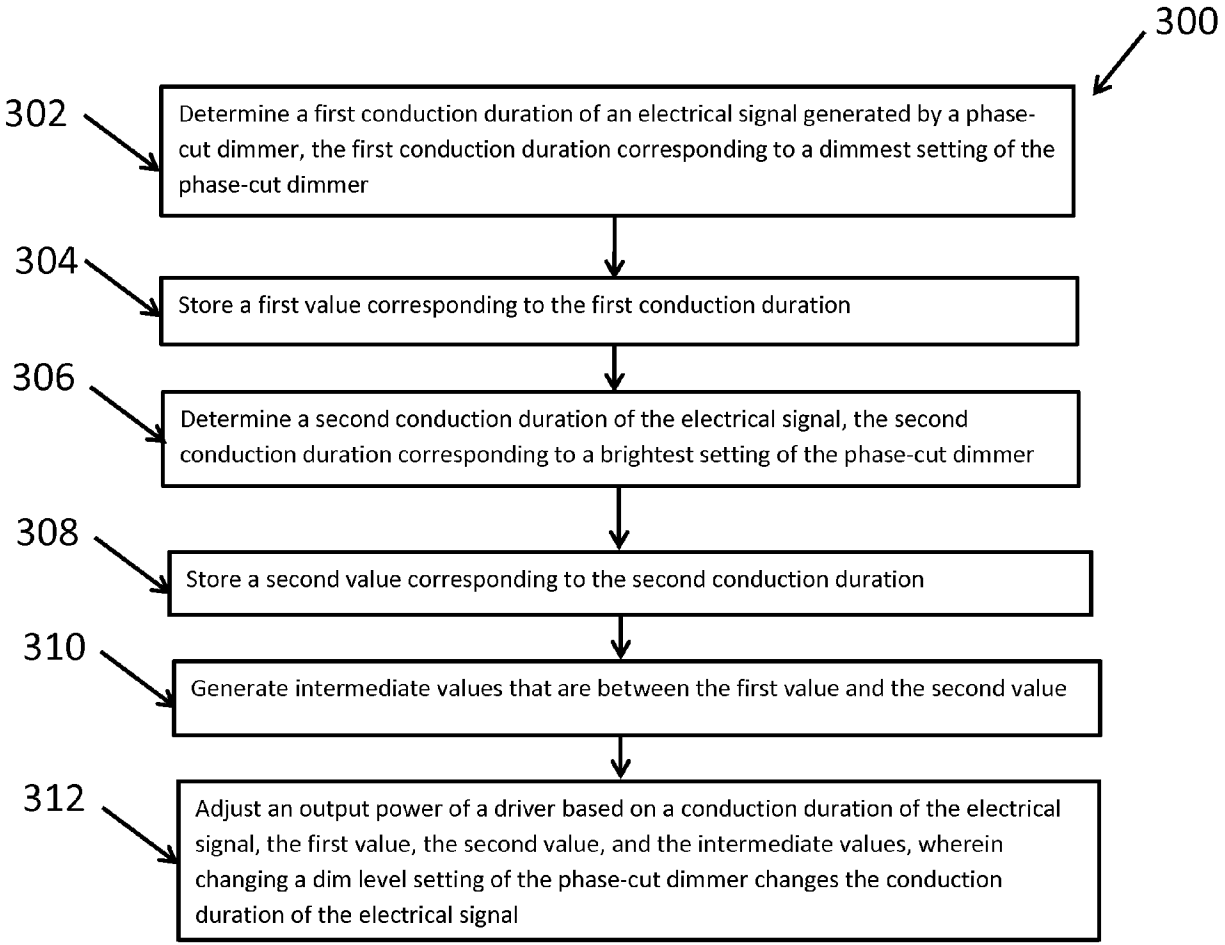
FIG. 3 is a flowchart illustrating a method of operating the lighting system of FIG. 1A according to an example embodiment.

FIG. 3 is a flowchart illustrating a method 300 of operating the lighting system 100 of FIG. 1A according to an example embodiment. Referring to FIGS. 1A-3, at step 302, the method 300 includes determining a first conduction duration of an electrical signal generated by the phase-cut dimmer 104. For example, the first conduction duration may correspond to a dimmest setting of the phase-cut dimmer 104, which results in a minimum conduction duration of the electrical signal generated by the dimmer 104. As described above, the electrical signal generated by the dimmer 104 is provided to the adaptive driver 102 to control the power provided the LEDs 106.

At step 304, the method 300 includes storing a first value corresponding to the first conduction duration. For example, the first value may be a PWM value (e.g., duty cycle, pulse width, etc.). To illustrate, the first value may be stored in the memory block 114 or the memory device 216.

At step 306, the method 300 includes determining a second conduction duration of the electrical signal. For example, the second conduction duration may correspond to a brightest setting of the phase-cut dimmer, which results in a maximum conduction duration of the electrical signal generated by the dimmer 104. At step 308, the method 300 includes storing a second value corresponding to the second conduction duration. For example, the second value may be a PWM value (e.g., duty cycle, pulse width, etc.). To illustrate, the second value may be stored in the memory block 114 or the memory device 216.

At step 310, the method 300 includes generating intermediate values that are between the first value and the second value. For example, the intermediate values may be PWM values (e.g., duty cycle, pulse width, etc.) that correspond to intermediate conduction durations that are between the first conduction duration and the second conduction duration. For example, the intermediate values may be generated by the logic block 218 based on the first and second values and a desired dimming curve (e.g., a linear curve). The intermediate values may be stored in the memory block 114 or the memory device 216.

At step 312, the method 300 includes adjusting an output power of the adaptive driver 102 based on a conduction duration of the electrical signal, the first value, the second value, and the intermediate values. For example, a conduction duration of the electrical signal may be determined (e.g., measured) by the conduction duration counter 112 or the conduction duration counter 214 as described above, and a stored value (i.e., the first, second or an intermediate value) corresponding to the conduction duration of the electrical signal may be read/output from the memory block 114 or the memory device 216 and provided to the power processor block 116 or the power processor 208. The power processor block 116 or the power processor 208 may adjust the power provided to the LEDs 106 based on the value read/output from the memory block 114 or the memory device 216. As explained above, different dim level settings of the dimmer 104 correspond to different conduction durations of the electrical signal generated by the dimmer 104 and provided to the adaptive driver 102. In general, changing the dim level setting of the phase-cut dimmer 104 may change the conduction duration of the electrical signal generated by the dimmer 104.

In some example embodiments, steps 302-310 may be performed after selecting a training mode operation of the system 100 or the adaptive driver 102. Step 212 may be performed during a normal mode operation of the system 100 or the adaptive driver 102. In some alternative embodiments, the steps of the method 300 may be performed in a different sequence without departing from the scope of this disclosure.

Figure 4:
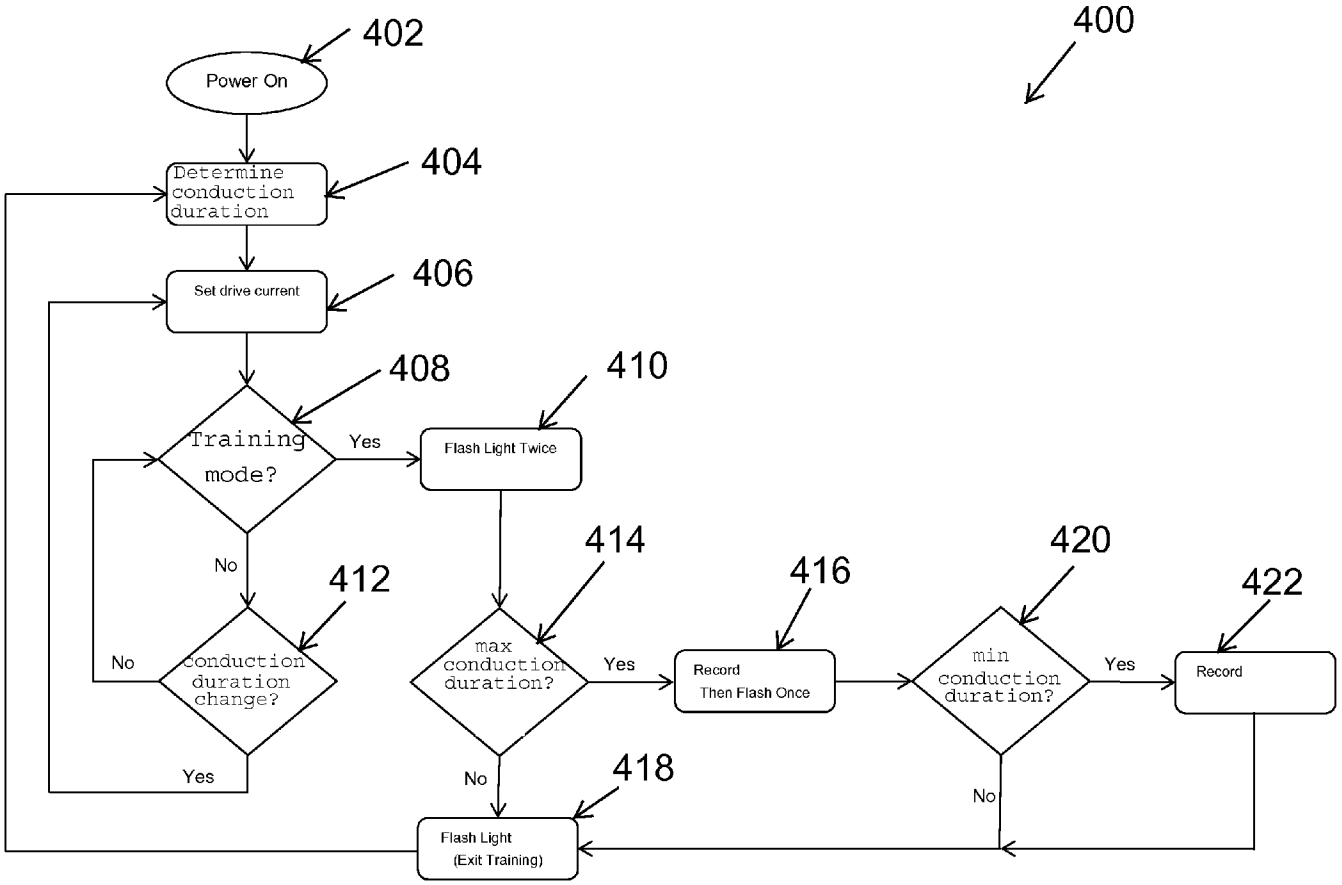
FIG. 4 is a flowchart illustrating a method of operating the lighting system of FIG. 1A according to another example embodiment.

FIG. 4 is a flowchart illustrating a method 400 of operating the lighting system 100 of FIG. 1A according to another example embodiment. Referring to FIGS. 1A-3, at step 402, the method 400 includes providing power to the lighting system 100. For example, the power source (SUPPLY) may be turned on to provide power to the system 100. At step 404, the method 400 includes determining a conduction duration of the electrical signal generated by the dimmer 104. At step 406, the method 400 includes setting the current output of the adaptive driver 102 (i.e., the current provided to the LEDs 106) based on the conduction duration determined at step 404 and values stored, for example, in the memory device 216. At step 408, the method 400 includes determining if training mode has been selected. If training mode has not been selected, the method 400 includes determining whether the conduction duration of the electrical signal generated by the dimmer 104 has changed at step 412. If no change in the conduction duration is detected, the method 400 returns to step 408 and continues to check whether training mode has been selected, for example, by a user. If a change in the conduction duration of the electrical signal generated by the dimmer 104 is detected at step 412, the method 400 returns to step 406 where the current output of the adaptive driver 102 is set based on the conduction duration.

In some example embodiments, if training mode is detected at step 408, the method 400 includes at step 410 flashing a light twice or providing another indication that training mode has be selected/detected. At step 414, the method 400 includes determining if a conduction duration of the electrical signal is the maximum conduction duration. For example, during training mode, a user may change the dim level setting of the dimmer 104 to a brightest setting and maintain the setting for at least a period of time (e.g., 2 seconds). To illustrate, the adaptive dimmer 104 may determine that a conduction duration is the maximum conduction duration if the conduction duration is maintained for at least a period of time and is greater than a threshold conduction duration value (e.g., 100 degrees). In some alternative embodiments, other means of determining the maximum conduction duration may be used as can be contemplated by those of ordinary skill in the art with the benefit of this disclosure. If a maximum conduction duration is not detected at step 414, the method 400 may exit training mode at step 418. For example, at step 418, a light may be flashed, for example, three times, to indicate exit from the training mode.

If the maximum conduction duration is determined at step 414, the method 400 may include at step 416 recording the maximum conduction duration. A light may be flashed (e.g., once) to indicate that the maximum conduction duration is recorded. At step 420, the method 400 may include determining if a conduction duration of the electrical signal is the minimum conduction duration. For example, during training mode, a user may change the dim level setting of the dimmer 104 to a dimmest setting and maintain the setting for at least a period of time (e.g., 2 seconds). To illustrate, the adaptive dimmer 104 may determine that a conduction duration is the minimum conduction duration if the conduction duration is maintained for at least a period of time and is less than a threshold conduction duration value (e.g., 50 degrees). If a minimum conduction duration is not detected at step 420, the method 400 may exit training mode at step 418. At step 422, the method 400 may include at step 416 recording the maximum conduction duration. For example, the recorded minimum and maximum durations may be used to generate power generation parameter values (e.g., duty cycle, pulse width, etc.) as described above. In some alternative embodiments, the steps of the method 400 may be performed in a different sequence without departing from the scope of this disclosure.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A method of adapting output power of a driver to conduction duration of a phase-cut dimmer, the method comprising:

determining a first conduction duration of an electrical signal generated by a phase-cut dimmer, the first conduction duration corresponding to a dimmest setting of the phase-cut dimmer;

storing a first value corresponding to the first conduction duration;

determining a second conduction duration of the electrical signal, the second conduction duration corresponding to a brightest setting of the phase-cut dimmer;

storing a second value corresponding to the second conduction duration;

generating intermediate values that are between the first value and the second value; and adjusting an output power of a driver based on a conduction duration of the electrical signal, the first value, the second value, and the intermediate values, wherein changing a dim level setting of the phase-cut dimmer changes the conduction duration of the electrical signal.

2. The method of claim 1, wherein the first value is stored associated with the first conduction duration, wherein the second value is stored associated with the second conduction duration, and wherein the intermediate values are stored associated with intermediate conduction durations that are between the first conduction duration and the second conduction duration.

3. The method of claim 1, wherein the intermediate values are generated based on the first value, the second value and a dimming curve, wherein the dimming curve is a linear curve, an S curve or a square law curve.

4. The method of claim 1, further comprising:

selecting a training mode of the dimmer;

changing the dim level setting to the brightest setting after selecting the training mode; and changing the dim level setting to the dimmest setting after changing the dim level setting to the brightest setting.

5. The method of claim 1, further comprising:

selecting a training mode of the dimmer;

changing the dim level setting to the dimmest setting after selecting the training mode; and changing the dim level setting to the brightest setting after changing the dim level setting to the dimmest setting.

6. The method of claim 1, wherein the first value, the second value, and the intermediate values are pulse-width-modulation values.

7. The method of Claim 1, wherein the storing the first value corresponding to the first conduction duration is performed if the electrical signal has the second conduction duration for a first threshold time period; and wherein storing the second value corresponding to the second conduction duration is performed if the electrical signal has the second conduction duration for a second threshold time period.

8. A lighting system, comprising:

a phase-cut dimmer;

a light source; and an adaptive driver coupled to the phase cut dimmer and to the light source, the adaptive driver comprising:

a conduction duration detector to determine a conduction duration of the electrical signal, wherein changing a dim level setting of the dimmer changes the conduction duration of the electrical signal;

a memory device to store values corresponding to the conduction duration of the electrical signal determined by the conduction duration detector, the values including a first value, a second value, and intermediate values that are between the first value and the second value, wherein the first value corresponds to a minimum conduction duration of the electrical signal determined by the conduction duration detector, wherein the second value corresponds to a maximum conduction duration of the electrical signal determined by the conduction duration detector, and the intermediate values correspond to intermediate conduction durations of the electrical signal; and a power processor to provide power to the light source based on the first value, the second value, and the intermediate values.

9. The system of claim 8, further comprising a rectifier to rectify the electrical signal generated by the phase-cut dimmer and to output a rectified electrical signal, wherein the conduction duration detector determines the conduction duration of the electrical signal based on the rectified electrical signal.

10. The system of claim 8, wherein the first value, the second value, and the intermediate values are stored in the memory device during a training mode operation of the adaptive driver.

11. The system of claim 8, wherein the power is provided to the light source via an electrical signal and wherein a pulse width of the electrical signal is adjusted based on the first value, the second value, and the intermediate values.

12. The system of claim 8, wherein the conduction duration detector comprises a zero crossing detector circuit and a counter to determine the conduction duration of the electrical signal.

13. The system of claim 8, further comprising a logic circuit to generate the intermediate values based on the first value, the second value, and a desired dimming curve.

14. The system of claim 13, wherein the desired dimming curve is a linear curve, an S curve or a square law curve.

15. The system of claim 8, further comprising a pulse-width-generator to adjust a pulse width of an output signal of the adaptive driver that is provided to the light source.

16. A lighting fixture, comprising:

a light emitting diode (LED) light source; and an adaptive driver coupled to the LED light source, the adaptive driver comprising:

a conduction duration detector to determine a conduction duration of the electrical signal based on the rectified electrical signal, wherein changing a dim level setting of the dimmer changes the conduction duration of the electrical signal;

a memory device to store values corresponding to the conduction duration of the electrical signal determined by the conduction duration detector, the values including a first value, a second value, and intermediate values that are between the first value and the second value, wherein the first value corresponds to a minimum conduction duration of the electrical signal determined by the conduction duration detector, wherein the second value corresponds to a maximum conduction duration of the electrical signal determined by the conduction duration detector, and the intermediate values correspond to intermediate conduction durations of the electrical signal; and a power processor to provide power to the LED light source based on the first value, the second value, and the intermediate values.

17. The lighting fixture of claim 16, further comprising a rectifier to rectify the electrical signal generated by the phase-cut dimmer and to output a rectified electrical signal, wherein the conduction duration detector determines the conduction duration of the electrical signal based on the rectified electrical signal.

18. The lighting fixture of claim 16, wherein the conduction duration detector comprises a zero crossing detector circuit and a counter to determine the conduction duration of the electrical signal.

19. The lighting fixture of claim 16, further comprising a logic circuit to generate the intermediate values based on the first value, the second value, and a desired dimming curve.

20. The lighting fixture of claim 16, wherein the LED light source comprises one or more light emitting diodes.

* * * * *